US009560882B2

(12) United States Patent
Xiang

(10) Patent No.: US 9,560,882 B2
(45) Date of Patent: Feb. 7, 2017

(54) METHOD AND DEVICE FOR GENERATING SMOKING SIGNALS AND ELECTRONIC CIGARETTE USING THE METHOD AND THE DEVICE

(71) Applicant: Zhiyong Xiang, Guangdong (CN)

(72) Inventor: Zhiyong Xiang, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 511 days.

(21) Appl. No.: 14/100,904

(22) Filed: Dec. 9, 2013

(65) Prior Publication Data

US 2015/0090277 A1 Apr. 2, 2015

(30) Foreign Application Priority Data

Sep. 27, 2013 (CN) ..... 2013 1 0450567

(51) Int. Cl.
*A24F 47/00* (2006.01)

(52) U.S. Cl.
CPC ..... *A24F 47/008* (2013.01)

(58) Field of Classification Search
CPC .... A24F 47/002; A24F 47/004; A24F 47/008; A61M 15/0085
USPC ..... 131/329
See application file for complete search history.

(56) References Cited

U.S. PATENT DOCUMENTS 5,404,871 A * 4/1995 Goodman ..... A61M 15/00 128/200.14
5,551,416 A * 9/1996 Stimpson ..... A61M 15/0085 128/200.14
5,694,919 A * 12/1997 Rubsamen ..... A61M 15/00 128/200.14
6,152,130 A * 11/2000 Abrams ..... A61M 15/0085 128/203.12
2007/0267031 A1* 11/2007 Hon ..... A24F 47/008 131/273
2012/0090630 A1* 4/2012 Hon ..... A24F 47/002 131/273

* cited by examiner

*Primary Examiner* — Joseph S Del Sole
*Assistant Examiner* — Mohamed K Ahmed Ali
(74) *Attorney, Agent, or Firm* — Tim Tingkang Xia, Esq.; Locke Lord LLP

(57) ABSTRACT

The present application provides a method and a device for generating smoking signals in electronic cigarettes and an electronic cigarette using the method and the device. The method includes these steps: using airflow passing through a vocal cavity of an electronic cigarette to drive the vocal cavity to vibrate and generate an ultrasonic wave; using an acoustic-electric conversion unit mounted on the vocal cavity to convert the ultrasonic wave into a voltage signal; and using a microprocessor of the electronic cigarette to generate a control signal according to the voltage signal and start a heating and atomizing process of tobacco juice in the electronic cigarette.

3 Claims, 4 Drawing Sheets

METHOD AND DEVICE FOR GENERATING SMOKING SIGNALS AND ELECTRONIC CIGARETTE USING THE METHOD AND THE DEVICE

CROSS-REFERENCE TO RELATED APPLICATIONS

This non-provisional application claims priority under 35 U.S.C. §119(a) on Patent Application No. 201310450567.4, filed in P.R. China on Sep. 27, 2013, the entire contents of which are hereby incorporated by reference.

FIELD OF THE INVENTION

The present application relates to the field of electronic cigarettes, and more particularly, relates to a method and a device for generating smoking signals in electronic cigarettes and an electronic cigarette using the method and the device.

BACKGROUND OF THE INVENTION

An electronic cigarette is a product that is configured to heat and atomize tobacco juice and thereby provide a substitute for cigarettes to consumers.

In use of an electronic cigarette, once a user begins to smoke the electronic cigarette, the electronic cigarette generates a smoking signal. Upon receiving the smoking signal, a microprocessor of the electronic cigarette starts a process of heating and atomizing tobacco juice. Therefore, generating the smoking signal is an important step of using the electronic cigarette.

In the prior art, most electronic cigarettes generate the smoking signals by two methods. One of the two methods is to mount a smoking sensor (e.g., an inhalation sensor) in an electronic cigarette. When the electronic cigarette is smoked, the smoking sensor can sense airflow changes and generate smoking signals correspondingly. The other of the two methods is to mount a start button on an electronic cigarette. Pressing the start button can generate smoking signals.

Since the smoking sensor can automatically generate smoking signals while the start button needs manual operations, conventional electronic cigarettes usually use smoking sensors to generate smoking signals. At present, most smoking sensors used in electronic cigarettes are thin film capacitive pressure sensors. When a user smokes an electronic cigarette equipped with a thin film capacitive pressure sensor, pressures applied to two thin films of a capacitor of the thin film capacitive pressure sensor are different from each other, and the two films are deformed. Thus, a capacitance of the capacitor is changed, and the capacitance change generates a smoking signal.

However, the thin films of the thin film capacitive pressure sensors generally require very high surface cleanliness. In use, if the tobacco juice in the electronic cigarettes seeps and reaches the thin films, the thin films may malfunction because the surface cleanliness of the thin films is unable to meet the requirement of the thin films. Thus, the thin film capacitive pressure sensors may be unable to generate smoking signals normally, which may adversely affect the use of the electronic cigarettes and shorten the service life of the electronic cigarettes.

SUMMARY OF THE INVENTION

The present application is configured to solve this technical problem: aiming at the aforementioned defects in the prior art, a method and a device for generating smoking signals in electronic cigarettes and an electronic cigarette using the method and the device are provided.

A technical solution of the present application configured to solve the aforementioned technical problem is that:

In one aspect, a device for generating smoking signals in an electronic cigarette is provided, and the device for generating smoking signals in the electronic cigarette comprises:

a vocal cavity mounted in an airflow channel of the electronic cigarette; and an acoustic-electric conversion unit mounted on the vocal cavity;

wherein the vocal cavity is configured to generate an ultrasonic wave with a specific frequency when air flow passes through the vocal cavity, and the acoustic-electric conversion unit is configured to convert the ultrasonic wave into a voltage signal acting as a smoking signal.

In one embodiment, the vocal cavity includes a main body and an extending body connected to the main body, a diameter of the main body is larger than a diameter of the extending body, and the extending body is hollow; the main body defines an air inlet; the extending body defines an acoustic groove and an acoustic hole in a circumferential side wall of the extending body, and a center connection line between a center of the acoustic groove and a center of the acoustic hole is parallel to a central axis of the vocal cavity.

In the embodiment, the acoustic-electric conversion unit includes a piezoelectric ceramic piece.

In another aspect, the present application further provides an electronic cigarette, and the electronic cigarette comprises:

a microprocessor;

a vocal cavity mounted in an airflow channel of the electronic cigarette; and an acoustic-electric conversion unit mounted on the vocal cavity and electrically connected to the microprocessor;

wherein the vocal cavity is configured to generate an ultrasonic wave with a specific frequency when airflow passes through the vocal cavity, the acoustic-electric conversion unit is configured to convert the ultrasonic wave into a voltage signal and transmit the voltage signal to the microprocessor, and the microprocessor is configured to generate a control signal according to the voltage signal and start a heating and atomizing process of tobacco juice in the electronic cigarette.

In one embodiment, the vocal cavity includes a main body and an extending body connected to the main body, a diameter of the main body is larger than a diameter of the extending body, and the extending body is hollow; the main body defines an air inlet; the extending body defines an acoustic groove and an acoustic hole in a circumferential side wall of the extending body, and a center connection line between a center of the acoustic groove and a center of the acoustic hole is parallel to a central axis of the vocal cavity.

In the embodiment, the electronic cigarette further includes a sleeve, and the sleeve defines at least one through hole communicating with the airflow channel; the through hole and the air inlet are configured to enable airflow to enter the extending body and generate the ultrasonic wave.

In the embodiment, the acoustic-electric conversion unit includes a piezoelectric ceramic piece.

In the embodiment, the microprocessor is configured to compare the voltage signal with a preset voltage threshold value, and generate the control signal and start the heating and atomizing process of the tobacco juice in the electronic cigarette when a voltage value of the voltage signal is larger than the preset voltage threshold value.

In the embodiment, the electronic cigarette further includes a battery, a heating wire, and a switch circuit; the battery is electrically connected to the microprocessor, and is configured to store electric power and provide a power supply voltage; the switch circuit is electrically connected to the battery, the microprocessor, and the heating wire, and is configured to electrically connect the battery to the heating wire to start the heating and atomizing process of the tobacco juice in the electronic cigarette under the control of the control signal generated by the microprocessor.

In a further aspect, the present application further provides a method for generating smoking signals in an electronic cigarette, and the method includes the following steps:

using airflow passing through a vocal cavity of the electronic cigarette to drive the vocal cavity to vibrate and generate an ultrasonic wave;

using an acoustic-electric conversion unit mounted on the vocal cavity to convert the ultrasonic wave into a voltage signal; and using a microprocessor of the electronic cigarette to generate a control signal according to the voltage signal and start a heating and atomizing process of tobacco juice in the electronic cigarette.

In the method for generating smoking signals in the electronic cigarette of the present application, the process that the microprocessor generates the control signal according to the voltage signal and starts the heating and atomizing process of the tobacco juice in the electronic cigarette includes:

the microprocessor compares the voltage signal with a preset voltage threshold value; if a voltage value of the voltage signal is larger than the preset voltage threshold value, the microprocessor determines that a smoking signal is generated; and when the microprocessor determines that the smoking signal is generated, the microprocessor further generates the control signal and starts the heating and atomizing process of the tobacco juice in the electronic cigarette.

By implementing the method and the device for generating smoking signals in electronic cigarettes and the electronic cigarette using the method and the device of the present application, the following advantages can be achieved: since the vocal cavity is independent of other components of the electronic cigarette (e.g., the microprocessor, the battery and etc.), the device for generating smoking signals does not malfunction although the tobacco juice seeps into the vocal cavity. Furthermore, when the electronic cigarette is used, the airflow formed by the smoking actions passes through the device for generating smoking signals before the tobacco juice is atomized. Thus, the sensitivity of the device for generating smoking signals can be enhanced, so that the smoking signals can be generated more reliably and sensitively. Additionally, the service life of the electronic cigarette can be extended.

DETAILED DESCRIPTION OF THE PREFERRED EMBODIMENT

Figure 1:
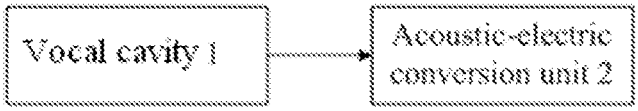
FIG. 1 is a block diagram of a device for generating smoking signals of an embodiment of the present application.

In order to understand the technical features, purpose and the effect of the present invention more clearly, the preferred specific embodiments of the present invention will be described referring to the drawings.

FIG. 1 is a block diagram of a device for generating smoking signals of an embodiment of the present application. The device for generating smoking signals is used in an electronic cigarette, and includes a vocal cavity 1 mounted in an airflow channel of the electronic cigarette and an acoustic-electric conversion unit 2 mounted on the vocal cavity 1. In particular, the acoustic-electric conversion unit 2 can be mounted on an outer surface or an inner surface of the vocal cavity 1. Furthermore, the vocal cavity 1 can also define an accommodating hole configured to accommodate the acoustic-electric conversion unit 2.

The vocal cavity 1 defines an air inlet 401. When the electronic cigarette is smoked by a user, airflow generated in the smoking process can pass through the vocal cavity 1 via the air inlet 401.

When airflow passes through the vocal cavity 1, the vocal cavity 1 generates an ultrasonic wave with a specific frequency (e.g., 20000 Hz or more). The acoustic-electric conversion unit 2 converts the ultrasonic wave into a voltage signal, and the voltage signal can act as a smoking signal.

In this embodiment of the present application, the vocal cavity 1 can be in any shape, as long as the vocal cavity 1 can generate the ultrasonic wave when the airflow generated in the smoking process passes through the vocal cavity 1. Understandably, in this embodiment of the present application, when the airflow passes through the vocal cavity 1, the vocal cavity 1 resonates and generates the ultrasonic wave.

In this embodiment, the device for generating smoking signals includes the vocal cavity 1 and the acoustic-electric conversion unit 2. Compared with thin film capacitive pressure sensors in the prior art (e.g., inhalation sensors), the device for generating smoking signals has a higher sensitivity, and still can generate the smoking signal normally even though tobacco juice in the electronic cigarette contaminates the vocal cavity 1. In this way, the user's use experience can be improved, and the service life of the electronic cigarette can be extended.

Figure 2:
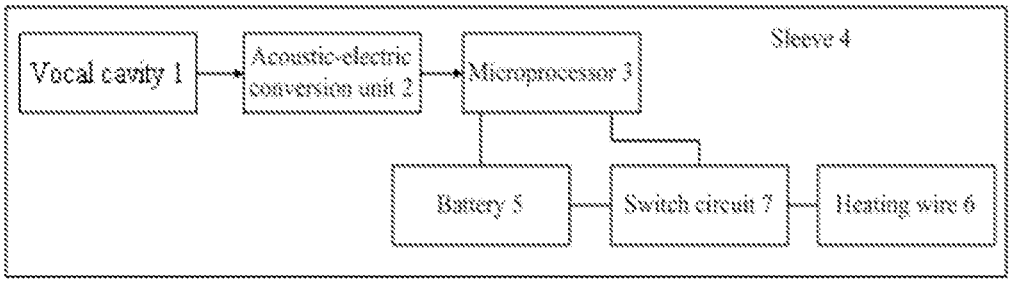
FIG. 2 is a block diagram of an electronic cigarette of a first preferred embodiment of the present application.

FIG. 2 is a block diagram of an electronic cigarette of a first preferred embodiment of the present application. In the first preferred embodiment of the present application, the electronic cigarette is an integrated electronic cigarette. That is, a battery rod of the electronic cigarette is integrated with an atomizer of the electronic cigarette.

The electronic cigarette of the first preferred embodiment of the preset application includes a sleeve 4, the vocal cavity 1, the acoustic-electric conversion unit 2, and a microprocessor 3. The sleeve 4 defines an accommodating space configured to accommodate the vocal cavity 1. Both the acoustic-electric conversion unit 2 and the microprocessor 3 are received in the sleeve 4. The acoustic-electric conversion unit 2 is mounted on the vocal cavity 1, and the acoustic-electric conversion unit 2 is electrically connected to the microprocessor 3.

Since the electronic cigarette of the first preferred embodiment of the preset application includes the vocal cavity 1, when airflow passes through the vocal cavity 1, the vocal cavity 1 generates an ultrasonic wave with a specific frequency. The acoustic-electric conversion unit 2 converts the ultrasonic wave into a voltage signal (i.e., generating a smoking signal), and the voltage signal is transmitted to the microprocessor 3. The microprocessor 3 compares the voltage signal with a preset voltage threshold value, and determines whether a smoking signal is generated according to the comparison result. Particularly, if a voltage value of the voltage signal received by the microprocessor 3 is larger than the preset voltage threshold value, the microprocessor 3 determines that the smoking signal is generated. When the microprocessor 3 determines that the smoking signal is generated, the microprocessor 3 further generates a control signal and starts a heating and atomizing process of the tobacco juice in the electronic cigarette.

In the electronic cigarette of the first preferred embodiment of the preset application, the acoustic-electric conversion unit 2 includes a piezoelectric ceramic piece. When a user of the electronic cigarette smokes the electronic cigarette, airflow generated by the smoking action passes through the vocal cavity 1, and the vocal cavity 1 generates the ultrasonic wave with the specific frequency. When the ultrasonic wave drives the piezoelectric ceramic piece to vibrate, the piezoelectric ceramic piece generates the voltage signal. In other words, the piezoelectric ceramic piece converts the ultrasonic wave into the voltage signal.

Understandably, for enabling the airflow generated by the smoking action of the user to enter the air inlet 401 of the vocal cavity 1, the sleeve 4 should define at least one through hole, and the through hole should communicate with the air inlet 401 of the vocal cavity 1. In this way, airflow entering the through hole can further enter the vocal cavity 1 via the air inlet 401 and drive the vocal cavity 1 to vibrate and generate the ultrasonic wave.

The size of the piezoelectric ceramic piece can be determined according to a sounding frequency of the vocal cavity 1, which acts as a resonance frequency of the piezoelectric ceramic piece.

In the first preferred embodiment of the present application, the microprocessor 3 can be a single-chip computer, an MCU, or an ASIC chip, etc.

Also referring to FIG. 2, the electronic cigarette of the first preferred embodiment of the preset application further includes a battery 5, a heating wire 6, and a switch circuit 7. The battery 5 is configured to store electric power and provide a power supply voltage. The switch circuit 7 is configured to connect or disconnect the battery 5 to the heating wire 6 according to the control signal generated by the microprocessor 3. The heating wire 6 is configured to generate heat to atomize tobacco juice. Wherein, the battery 5 is electrically connected to the microprocessor 3, and the switch circuit 7 is electrically connected to the battery 5, the microprocessor 3, and the heating wire 6 respectively.

In the electronic cigarette of the first preferred embodiment of the preset application, when the microprocessor 3 outputs the control signal to start the heating and atomizing process of the tobacco juice, the microprocessor 3 controls the switch circuit 7 to be switched on, and the battery 5 supplies electric power to the heating wire 6, the heating wire 6 is electrified and generates heat, so that the tobacco juice in the electronic cigarette is heated and atomized.

Figure 3:
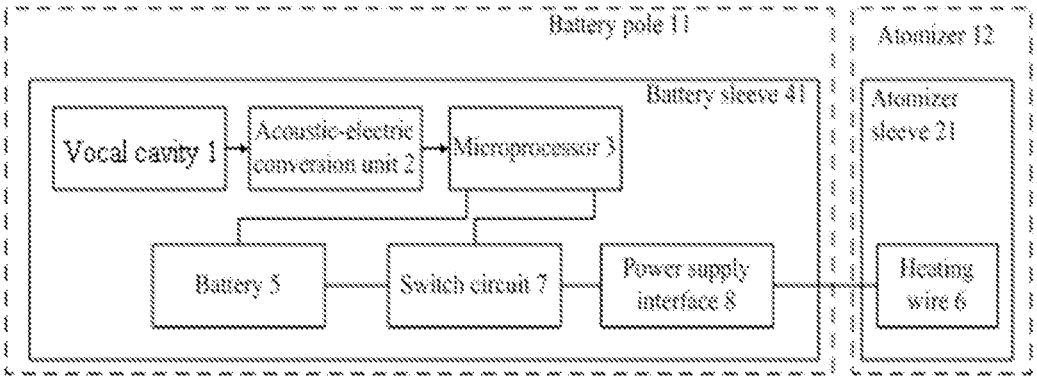
FIG. 3 is a block diagram of an electronic cigarette of a second preferred embodiment of the present application.

FIG. 3 is a block diagram of an electronic cigarette of a second preferred embodiment of the present application. In the second preferred embodiment of the present application, the electronic cigarette includes a battery pole 11 and an atomizer 12 detachably connected to the battery pole 11.

In the electronic cigarette of the second preferred embodiment of the present application, the atomizer 12 includes an atomizer sleeve 21 and a heating wire 6 accommodated in the atomizer sleeve 21.

In the electronic cigarette of the second preferred embodiment of the present application, the battery pole 11 includes a battery sleeve 41, the vocal cavity 1, the acoustic-electric conversion unit 2, and a microprocessor 3. The battery sleeve 41 defines an accommodating space configured to accommodate the vocal cavity 1. Both the acoustic-electric conversion unit 2 and the microprocessor 3 are received in the battery sleeve 41. The acoustic-electric conversion unit 2 is mounted on the vocal cavity 1, and the acoustic-electric conversion unit 2 is electrically connected to the microprocessor 3.

Understandably, the battery sleeve 41 and the atomizer sleeve 21 can cooperatively form a whole sleeve of the electronic cigarette.

The battery pole 11 further includes a battery 5, a switch circuit 7, and a power supply interface 8 configured to electrically connect to the heating wire 6. Both the battery 5 and the switch circuit 7 are received in the battery sleeve 41. The power supply interface 8 is electrically connected to the switch circuit 7. When the atomizer 12 is mechanically connected to the battery pole 11, the power supply interface 8 is further electrically connected to the heating wire 6 of the atomizer 12.

Since the electronic cigarette of the second preferred embodiment of the preset application includes the vocal cavity 1, when airflow passes through the vocal cavity 1, the vocal cavity 1 generates an ultrasonic wave with a specific frequency. The acoustic-electric conversion unit 2 converts the ultrasonic wave into a voltage signal, and the voltage signal is transmitted to the microprocessor 3. The microprocessor 3 compares the voltage signal with a preset voltage threshold value, and determines whether a smoking signal is generated according to the comparison result. Particularly, if a voltage value of the voltage signal received by the microprocessor 3 is larger than the preset voltage threshold value, the microprocessor 3 determines that the smoking signal is generated. When the microprocessor 3 determines that the smoking signal is generated, the microprocessor 3 further generates a control signal and starts a heating and atomizing process of the tobacco juice in the electronic cigarette. When the microprocessor 3 outputs the control signal to start the heating and atomizing process of the tobacco juice, the microprocessor 3 controls the switch circuit 7 to be switched on, and the battery 5 supplies electric power to the heating wire 6, the heating wire 6 is electrified and generates heat, so that the tobacco juice in the electronic cigarette is heated and atomized.

Understandably, in the electronic cigarette of the second preferred embodiment of the preset application, the vocal cavity 1 and the acoustic-electric conversion unit 2 can also be disposed in the atomizer sleeve 21, as long as the acoustic-electric conversion unit 2 is electrically connected to the microprocessor 3 and the aforementioned smoking signal still can be generated when the atomizer 12 is mechanically connected to the battery pole 11. When the vocal cavity 1 and the acoustic-electric conversion unit 2 are disposed in the atomizer sleeve 21, they work similarly as being disposed in the battery sleeve 41, and the details do not need to be repeated here.

Understandably, for enabling the airflow generated by the smoking action of the user to enter the air inlet 401 of the vocal cavity 1, the battery sleeve 41 or the atomizer sleeve 21 of the electronic cigarette should define at least one through hole, and the through hole should communicate with the air inlet 401 of the vocal cavity 1. In this way, airflow entering the through hole can further enter the s vocal cavity 1 via the air inlet 401 and drive the vocal cavity 1 to vibrate and generate the ultrasonic wave.

Figure 4:
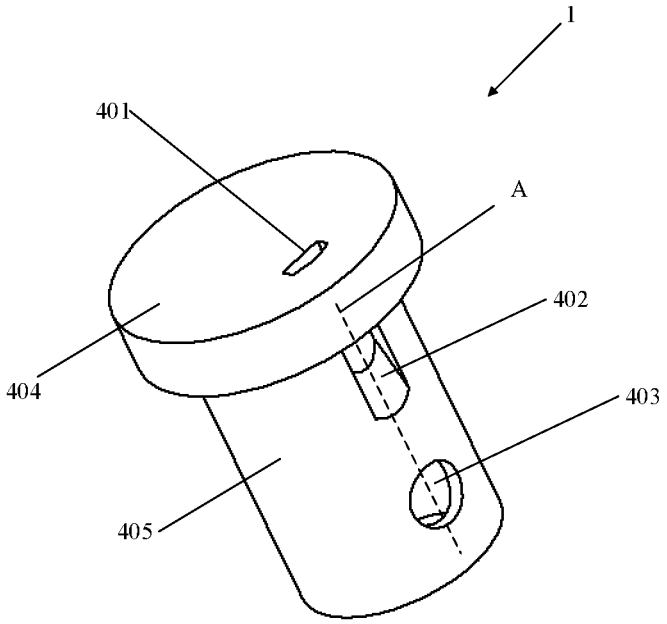
FIG. 4 is a structural schematic view of a vocal cavity of an embodiment of the present application.

FIG. 4 is a structural schematic view of a vocal cavity of an embodiment of the present application. The vocal cavity 1 includes a main body 404 and an extending body 405 connected to the main body 404, a diameter of the main body 404 is larger than a diameter of the extending body 405, and the extending body 405 is hollow. The main body 404 defines the air inlet 401. The extending body 405 defines an acoustic groove 402 and an acoustic hole 403 in a circumferential side wall of the extending body 405. Particularly, a center connection line A between a center of the acoustic groove 402 and a center of the acoustic hole 403 is parallel to a central axis B of the vocal cavity 1. When airflow enters the hollow extending body 405 via the air inlet 401, the vocal cavity 1 is driven to vibrate and generates the ultrasonic wave. The specific method for generating the ultrasonic wave can be the prior art. For example, the method can follow the principle for generating ultrasonic waves by dog whistles or sirens, as long as the vocal cavity 1 can generate ultrasonic waves. Therefore, the method does not need to be detailed here.

Figure 5:
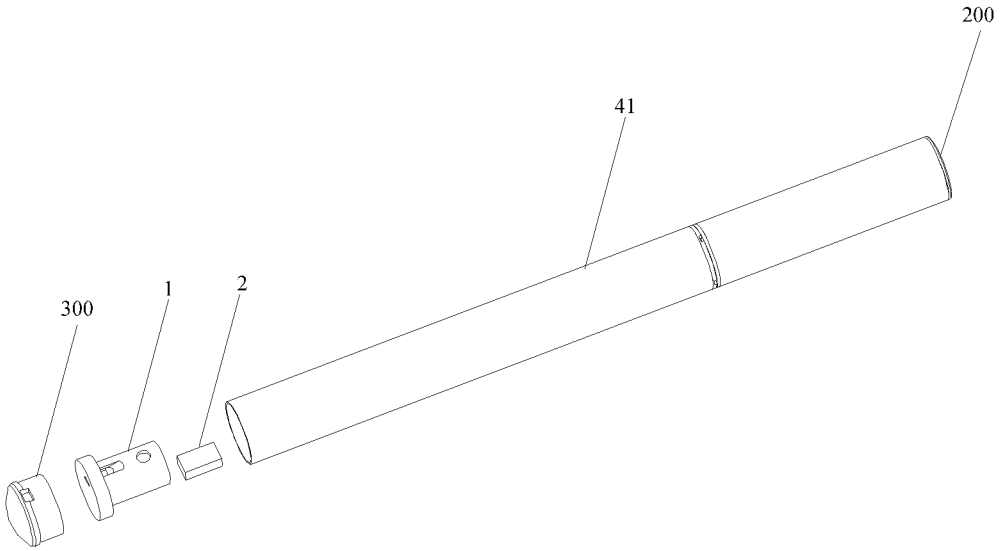
FIG. 5 is a structural schematic view of an electronic cigarette of the second preferred embodiment of the present application.

FIG. 5 is a structural schematic view of an electronic cigarette of the second preferred embodiment of the present application. As shown in FIG. 5, in this embodiment, the electronic cigarette includes the battery pole (not labeled) and the atomizer (not labeled) detachably connected to the battery pole. The atomizer includes a suction nozzle 200. The battery pole includes the battery sleeve 41, a lamp cap 300, the vocal cavity 1, and the acoustic-electric conversion unit 2. Both the vocal cavity 1 and the acoustic-electric conversion unit 2 are received in the battery sleeve 41.

Figure 6:
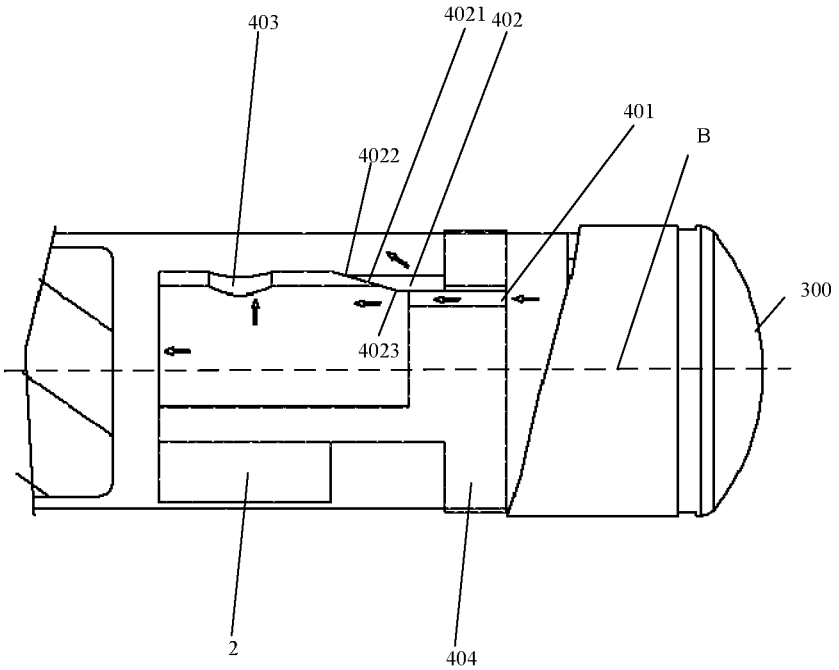
FIG. 6 is a partially cut-away view of the electronic cigarette shown in FIG. 5.

FIG. 6 is a partially cut-away view of the electronic cigarette shown in FIG. 5. The vocal cavity 1 includes the main body 404, and defines the air inlet 401, the acoustic groove 402, and the acoustic hole 403. The main body 404 is embedded in the battery sleeve 41. The extending body (not labeled), which is hollow, is connected to the main body 404, and a diameter of the main body 404 is larger than a diameter of the extending body. The acoustic groove 402 and the acoustic hole 403 are defined in a circumferential side wall of the extending body. The acoustic groove 402 forms a slope 4021, and the slope 4021 inclines towards the central axis B of the vocal cavity 1. Particularly, the slope 4021 gradually approaches the central axis B of the vocal cavity 1 from a first end 4022 of the slope 4021 to a second end 4023 of the slope 4021; wherein, the first end 4022 is far away from the main body 404, and the second end 4023 is close to the main body 404. Understandably, in this embodiment of the present application, the vocal cavity 1 should be positioned in an airflow channel of the battery sleeve 41 of the electronic cigarette. The airflow channel is formed by the following means: the battery sleeve 41 defines least one through hole; when a user smokes the electronic cigarette using the suction nozzle 200, external airflow enters the electronic cigarette via the air through hole, and the airflow channel is formed. When the user smokes, the airflow in the airflow channel can enter the hollow extending body via the through hole and the air inlet 401. When the airflow enters the extending body, the slope 4021 is driven to vibrate. Also referring to FIG. 5, the acoustic-electric conversion unit 2 is mounted on an outer surface of the vocal cavity 1. Moreover, the acoustic-electric conversion unit 2 can also be mounted on an inner surface of the vocal cavity 1.

Furthermore, the vocal cavity 1 shown in FIG. 6 can also be mounted in the atomizer sleeve 21, as long as the vocal cavity 1 is positioned in the airflow channel for smoking actions applied to the electronic cigarette.

Understandably, the vocal cavity 1 shown in FIG. 6 is also suitable for the device for generating smoking signals of the aforementioned embodiment of the present application and the electronic cigarette of the first preferred embodiment of the present application. When the vocal cavity 1 shown in FIG. 6 is used in the electronic cigarette of the first preferred embodiment of the present application, the vocal cavity 1 should be positioned in the airflow channel for smoking actions applied to the electronic cigarette, too. Particularly, the vocal cavity 1 can be positioned in an airflow channel formed in the sleeve 4. The acoustic-electric conversion unit 2 can be mounted on the vocal cavity 1 and electrically connected to the microprocessor 3.

Figure 7:
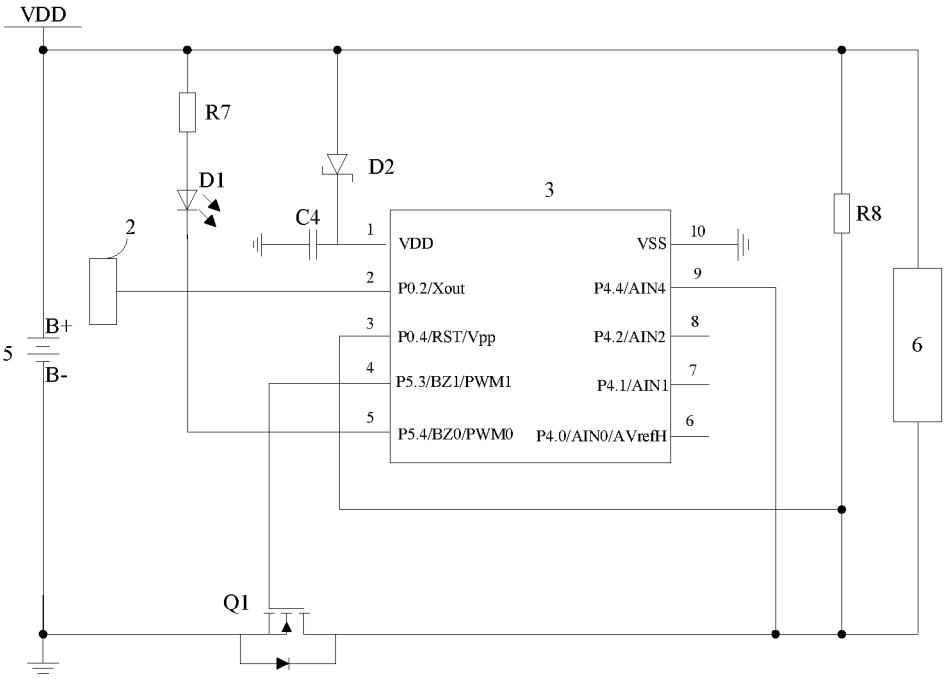
FIG. 7 is a circuit diagram of an electronic cigarette of an embodiment of the present application.

FIG. 7 is a circuit diagram of an electronic cigarette of an embodiment of the present application. The type of the microprocessor 3 is SN8P2711. The acoustic-electric conversion unit 2 includes a piezoelectric ceramic piece. The switch circuit 7 includes an MOS transistor Q1. The piezoelectric ceramic piece is electrically connected to a second pin of the microprocessor 3. The source of the MOS transistor Q1 is electrically connected to a negative electrode of the battery 5, the gate of the MOS transistor Q1 is electrically connected to a fourth pin of the microprocessor 3, and the drain of the MOS transistor Q1 is electrically connected to one end of the heating wire 6. The other end of the heating wire 6 is electrically connected to a positive electrode of the battery 5.

In this embodiment of the present application, the MOS transistor Q1 can also be replaced by a triode, a thyristor, or other types of transistors, as long as the replacements can achieve the same function as the MOS transistor Q1.

The circuit of the electronic cigarette of this embodiment of the present application further includes an LED D1 configured to indicate the working status of the electronic cigarette, a voltage stabilizing diode D2 configured to stabilize the working voltage of the electronic cigarette, and two resistors R7, R8. Wherein, a first pin of the microprocessor 3 is electrically connected to a cathode of the voltage stabilizing diode D2, and an anode of the voltage stabilizing diode D2 is electrically connected to the positive electrode of the battery 5; an anode of the LED D1 is electrically connected to one end of the resistor R7, and the other end of the resistor R7 is electrically connected to the positive electrode of the battery 5; a cathode of the LED D1 is electrically connected to a fifth pin of the microprocessor 3; a third pin of the microprocessor 3 is electrically connected to one end of the resistor R8 and the drain of the MOS transistor Q1; and the other end of the resistor R8 is electrically connected to the positive electrode of the battery 5.

Referring to FIG. 7, when the microprocessor 3 needs to output the control signal to start the heating and atomizing process of the tobacco juice, the microprocessor 3 controls the fourth pin to generate a preset high electric level, and the MOS transistor Q1 of the switch circuit 7 is switched on by the high electric level.

Particularly, in the working process of the electronic cigarette, when the microprocessor 3 receives a voltage signal from the piezoelectric ceramic piece, the microprocessor 3 compares the voltage signal with a preset voltage threshold value. If the voltage value of the voltage signal received by the microprocessor 3 is larger than the preset voltage threshold value, the microprocessor 3 controls the MOS transistor Q1 to be switched on, so that the battery 5 supplies electric power to the heating wire 6, the heating wire 6 is electrified and generates heat, and the tobacco juice of the electronic cigarette is heated and atomized.

In the process of supplying electric power to the heating wire 6, the microprocessor 3 controls the fourth pin to output a PWM pulse with a stable duty ratio, and the PWM pulse controls the MOS transistor Q1 to be turned on and off. In this way, the working voltage provided to the heating wire 6 can be adjusted, and thus the working status of the heating wire 6 can be adjusted correspondingly. Furthermore, in the process of supplying electric power, the microprocessor 3 can detect a voltage on a ninth pin thereof to protect the electronic cigarette from short circuit. Particularly, if short-circuit happens, the voltage on the ninth pin of the microprocessor 3 will change suddenly (i.e., the voltage will increase suddenly). Upon detecting that the voltage on the ninth pin changes suddenly, the microprocessor 3 controls the fourth pin thereof to generate a preset low electric level, and the low electric level controls the MOS transistor Q1 to be switched off. Thus, the process of supplying electric power is stopped, and the electronic cigarette is protected from short-circuit. In the process of supplying electric power, the LED D1 can indicate the working status of the electronic cigarette and achieve gradual display for the indication of smoking actions and stopping smoking actions applied to the electronic cigarette. Particularly, the microprocessor 3 can adjust a voltage on a fifth pin thereof to change the brightness of the light emitted by the LED D1, and different brightness of the light emitted by the LED D1 can be used to indicate a normal working status and various abnormal working statuses of the electronic cigarette respectively. Wherein, the abnormal working statuses can include short circuit, low battery, etc. Moreover, the microprocessor 3 can control the voltage on the fifth pin to increase or decrease gradually, and thereby control the brightness of the light emitted by the LED D1 to change gradually. In this way, the gradual display for the indication of smoking actions and stopping smoking actions applied to the electronic cigarette can be achieved.

Furthermore, in the process of supplying electric power, if an electric level on the second pin of the microprocessor 3 keeps being a preset high electric level for a preset period, the microprocessor 3 determines that a smoking signal always exists in this period (i.e., the voltage value of the voltage signal generated by the piezoelectric ceramic piece is always larger than the preset voltage threshold value), and further determines that the electronic cigarette is always smoked during this period. In this situation, the microprocessor 3 can control the MOS transistor Q1 to be turned off, so that the electronic cigarette being smoked for a long time is prevent from becoming too hot and scalding user. Thus, the present application can achieve a protection function for the situation that the electronic cigarette is smoked for a long time. In this embodiment of the present application, the aforementioned preset period can be adjusted, that is, a time span during which the electronic cigarette is allowed to be smoked can be adjusted.

In the process of supplying electric power, the microprocessor 3 can detect the power supply voltage by measuring a voltage on the third pin. When the voltage value of the power supply voltage is larger than a preset power supply voltage value, the microprocessor 3 can control the MOS transistor Q1 to be switched off via the fourth pin, thereby achieving an over-voltage protection.

Understandably, the circuit shown in FIG. 7 can be used in both the electronic cigarette of the first preferred embodiment of the present application and the electronic cigarette of the second preferred embodiment of the present application.

Figure 8:
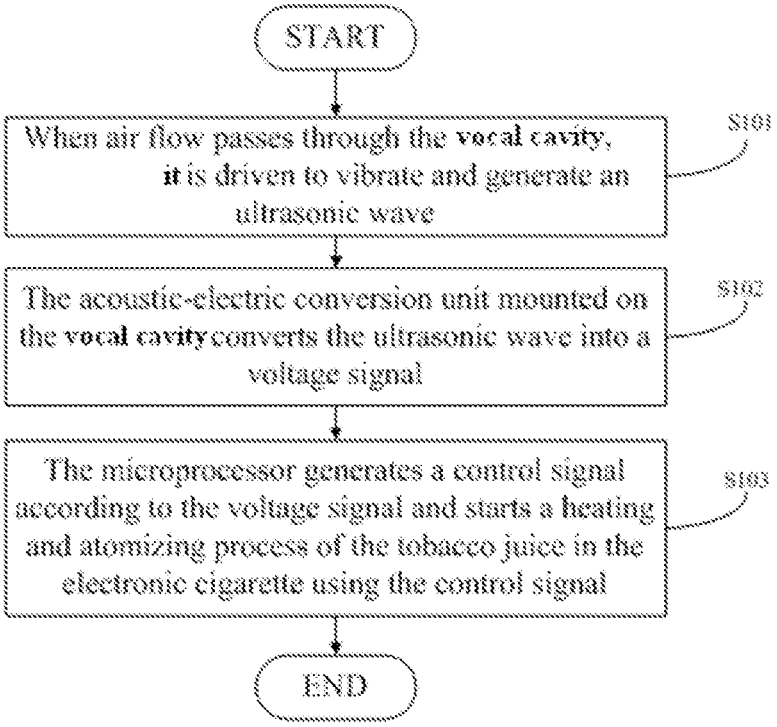
FIG. 8 is a flow chart of a method for generating smoking signals of an embodiment of the present application.

FIG. 8 is a flow chart of a method for generating smoking signals of an embodiment of the present application. The method can be executed by the electronic cigarette of any one of the aforementioned electronic cigarette embodiments of the present application, and includes the following steps:

Step S101, when airflow passes through the vocal cavity 1, the vocal cavity 1 is driven to vibrate and generate an ultrasonic wave.

Step S102, the acoustic-electric conversion unit 2 mounted on the vocal cavity 1 converts the ultrasonic wave into a voltage signal.

Step S103, the microprocessor 3 generates a control signal according to the voltage signal, and starts a heating and atomizing process of the tobacco juice in the electronic cigarette.

Particularly, the microprocessor 3 compares the voltage signal with a preset voltage threshold value. If a voltage value of the voltage signal is larger than the preset voltage threshold value, the microprocessor 3 determines that a smoking signal is generated. When the microprocessor 3 determines that the smoking signal is generated, the microprocessor 3 further generates the control signal and starts the heating and atomizing process of the tobacco juice in the electronic cigarette.

The method and the device for generating smoking signals in electronic cigarettes and the electronic cigarette using the method and the device, in accordance with the aforementioned embodiments of the present application, have the following advantages: since the vocal cavity 1 is independent of other components of the electronic cigarette (e.g., the microprocessor 3, the battery 5, and etc.), the device for generating smoking signals does not malfunction although the tobacco juice seeps into the vocal cavity 1. Furthermore, when the electronic cigarette is used, the airflow formed by the smoking actions passes through the device for generating smoking signals before the tobacco juice is atomized. Thus, the sensitivity of the device for generating smoking signals can be enhanced, so that the smoking signals can be generated more accurately and sensitively.

While the present invention has been described with the drawings to preferred embodiments which is merely a hint rather than a limit, it will be understood by those skilled in the art that various changes may be made and equivalents may be substituted without departing from the scope of the present invention. But all the changes will be included within the scope of the appended claims.

What is claimed is:

1. An electronic cigarette, comprising:

a microprocessor;

a vocal cavity mounted in an airflow channel of the electronic cigarette;

a battery sleeve;

and an acoustic-electric conversion unit electrically connected to the microprocessor;

the vocal cavity and the acoustic-electric conversion unit are mounted in the battery sleeve;

wherein the vocal cavity includes a main body and an extending body connected to the main body, a diameter of the main body is larger than a diameter of the extending body, and the extending body is hollow; the main body defines an air inlet the extending body defines an acoustic groove and an acoustic hole in a circumferential side wall of the extending body, and a center connection line between a center of the acoustic groove and a center of the acoustic hole is parallel to a central axis of the vocal cavity;

wherein the acoustic groove forms a slope, the slope gradually approaches the central axis of the vocal cavity from a first end of the slope to a second end of the slope; wherein the first end is away from the main body, and the second end is close to the main body;

wherein the battery sleeve defines least one through hole, external airflow enters the electronic cigarette via the air through hole, and an airflow channel is formed; the airflow in the airflow channel enters the extending body which is hollow via the through hole and the air inlet, when the airflow enters the extending body, the slope is driven to vibrate, the vocal cavity is configured to convert the external airflow into an ultrasonic wave with a specific frequency;

wherein the acoustic-electric conversion unit is a piezoelectric ceramic piece mounted in an internal sidewall of the vocal cavity, and is configured to convert the ultrasonic wave into a voltage signal and transmit the voltage signal to the microprocessor and;

wherein the microprocessor is configured to generate a control signal according to the voltage signal and start a heating and atomizing process of tobacco juice in the electronic cigarette.

2. The electronic cigarette according to claim 1, wherein the microprocessor is configured to compare the voltage signal with a preset voltage threshold value, and generate the control signal and start the heating and atomizing process of the tobacco juice in the electronic cigarette when a voltage value of the voltage signal is larger than the preset voltage threshold value.

3. The electronic cigarette according to claim 1, wherein the electronic cigarette further includes a battery, a heating wire, and a switch circuit; the battery is electrically connected to the microprocessor, and is configured to store electric power and provide a power supply voltage; the switch circuit is electrically connected to the battery, the microprocessor, and the heating wire, and is configured to electrically connect the battery to the heating wire to start the heating and atomizing process of the tobacco juice in the electronic cigarette under the control of the control signal generated by the microprocessor; the type of the microprocessor is SN8P2711;

wherein the piezoelectric ceramic piece is electrically connected to a second pin of the microprocessor, a source electrode of the MOS transistor Q1 is electrically connected to a negative electrode of the battery, a gate electrode of the MOS transistor Q1 is electrically connected to a fourth pin of the microprocessor, and a drain electrode of the MOS transistor Q1 is electrically connected to one end of the heating wire, the other end of the heating wire is electrically connected to a positive electrode of the battery; wherein the electronic cigarette further comprises an LED configured to indicate the working status of the electronic cigarette, a voltage stabilizing diode configured to stabilize the working voltage of the electronic cigarette, and two resistors R7, R8;

wherein a first pin of the microprocessor is electrically connected to a cathode of the voltage stabilizing diode, and an anode of the voltage stabilizing diode is electrically connected to the positive electrode of the battery; an anode of the LED is electrically connected to one end of the resistor R7, and the other end of the resistor R7 is electrically connected to the positive electrode of the battery; a cathode of the LED is electrically connected to a fifth pin of the microprocessor; a third pin of the microprocessor is electrically connected to one end of the resistor R8 and the drain of the MOS transistor Q1; and the other end of the resistor R8 is electrically connected to the positive electrode of the battery; when the microprocessor receives a voltage signal from the piezoelectric ceramic piece, the microprocessor compares the voltage signal with a preset voltage threshold value, if the voltage value of the voltage signal received by the microprocessor is larger than the preset voltage threshold value, the microprocessor controls the MOS transistor Q1 to be switched on, so that the battery supplies electric power to the heating wire, the heating wire is electrified and generates heat and the tobacco juice of the electronic cigarette is heated and atomized; wherein the vocal cavity is independent of other components of the electronic cigarette, the components include the microprocessor and the battery, and the vocal cavity for generating smoking signals does not malfunction although the tobacco juice seeps into the vocal cavity.

* * * * *